US012746435B2

(12) United States Patent
Yoo

(10) Patent No.: US 12,746,435 B2
(45) Date of Patent: Sep. 29, 2026

(54) DEVICE AND METHOD FOR COMPARING EXERCISE PERFORMANCE

(71) Applicant: DRAX INC., Gyeonggi-do (KR)

(72) Inventor: Seon Kyung Yoo, Seoul (KR)

(73) Assignee: DRAX INC., Gyeonggi-do (KR)

( * ) Notice: Subject to any disclaimer, the term of this patent is extended or adjusted under 35 U.S.C. 154(b) by 131 days.

(21) Appl. No.: 18/702,326

(22) PCT Filed: Dec. 14, 2022

(86) PCT No.: PCT/KR2022/020363

§ 371 (c)(1),
(2) Date: Apr. 17, 2024

(87) PCT Pub. No.: WO2023/128409

PCT Pub. Date: Jul. 6, 2023

(65) Prior Publication Data

US 2024/0416179 A1 Dec. 19, 2024

(30) Foreign Application Priority Data

Dec. 28, 2021 (KR) ..... 10-2021-0190357
Dec. 9, 2022 (KR) ..... 10-2022-0171966

(51) Int. Cl.
*A63B 24/00* (2006.01)

(52) U.S. Cl.
CPC ..... *A63B 24/0062* (2013.01); *A63B 2024/0065* (2013.01); *A63B 2024/0068* (2013.01)

(58) Field of Classification Search
CPC ..... A63B 24/0062; A63B 2024/0065; A63B 2024/0068
See application file for complete search history.

(56) References Cited

U.S. PATENT DOCUMENTS

2007/0219059 A1* 9/2007 Schwartz ..... A61B 5/329 482/8
2007/0250291 A1* 10/2007 Beale ..... A63B 24/0062 702/182

(Continued)

FOREIGN PATENT DOCUMENTS

CN 101152600 4/2008
CN 108053864 5/2018

(Continued)

OTHER PUBLICATIONS

"Search Report of Europe Counterpart Application", issued on Oct. 31, 2025, pp. 1-13.

(Continued)

*Primary Examiner* — Joshua T Kennedy
(74) *Attorney, Agent, or Firm* — JCIPRNET

(57) ABSTRACT

An embodiment of the present disclosure provides a method performed, by an exercise performance comparison device, of comparing exercise performance between users with different physical strength characteristics and physical conditions. To this end, the method collects workout data by communicating with each piece of fitness equipment used by users constituting a first group and users constituting a second group, and then, based thereon, calculating a fitness index of the users, and comparing exercise performance between the first group and the second group.

15 Claims, 8 Drawing Sheets

(56) References Cited

U.S. PATENT DOCUMENTS

2008/0086318 A1* 4/2008 Gilley ..... G16H 10/20 705/319
2008/0096726 A1* 4/2008 Riley ..... A63B 24/0087 482/8
2012/0050529 A1 3/2012 Bentley
2012/0295676 A1 11/2012 Ackerson et al.
2013/0165195 A1 6/2013 Watterson
2013/0338802 A1* 12/2013 Winsper ..... G16H 20/30 700/92
2014/0280219 A1* 9/2014 Maser ..... G11B 27/034 707/748
2019/0351283 A1 11/2019 Smith et al.
2020/0014967 A1* 1/2020 Putnam ..... A61B 5/6891
2021/0178226 A1* 6/2021 Abecassis ..... A63B 24/0075
2021/0402259 A1* 12/2021 Belson ..... A63B 24/0087
2022/0262511 A1* 8/2022 Tchao ..... A63B 24/0062
2022/0296966 A1* 9/2022 Asikainen ..... G16H 20/30
2023/0018013 A1* 1/2023 Allway ..... G16H 20/30
2023/0071274 A1* 3/2023 Trehan ..... A63B 24/0062
2023/0343450 A1* 10/2023 Aragones ..... A61B 5/1118
2023/0381589 A1* 11/2023 Paddock ..... G16H 15/00
2023/0389822 A1* 12/2023 Palamadai ..... A61B 5/1118

FOREIGN PATENT DOCUMENTS

CN 112675518 4/2021
JP 2015061610 4/2015
KR 1020160108808 9/2016
KR 1020210120153 10/2021
KR 20230160728 A * 11/2023 ..... G06Q 50/22
KR 102690196 B1 * 8/2024 ..... G16H 50/30

OTHER PUBLICATIONS

"Office Action of China Counterpart Application No. 202280079435.2", issued on Jul. 14, 2026, with English translation thereof, pp. 1-17.

* cited by examiner

DEVICE AND METHOD FOR COMPARING EXERCISE PERFORMANCE

TECHNICAL FIELD

The present disclosure relates to a method of comparing exercise performance between a plurality of users or groups with different physical strength characteristics.

BACKGROUND ART

Generally, when one works out, setting workout goals or competing with others serves as a main motivation for working out. However, when competing with others, if there is a significant difference from others in workout level, for example, in exercise ability such as a muscle strength, there is no competition.

DISCLOSURE

Technical Problem

An embodiment of the present disclosure provides a method, performed by an exercise performance comparison device, of comparing exercise performance between users with different physical strength characteristics and physical conditions.

An embodiment of the present disclosure provides an exercise performance comparison device for converting or changing physical strength characteristics and physical conditions of users with different physical characteristics and physical conditions into percentiles based on preset standards to effectively compare exercise performance between different groups or a plurality of users.

Technical Solution

According to an embodiment of the present disclosure, there is provided an exercise performance comparison device including a collector configured to collect workout data by communicating with each piece of fitness equipment used by users constituting a first group and users constituting a second group, a calculator configured to calculate, based on the collected workout data, a fitness index of the users constituting the first group and a fitness index of the users constituting the second group, and a comparator configured to compare exercise performance between the first group and the second group with different physical strength characteristics based on the fitness index of the users constituting the first group and the fitness index of the users constituting the second group, wherein the fitness index includes at least one of an exercise ability index and a workout record index.

The fitness index may further include a body type index, the comparator may compare the exercise performance between the first group and the second group with different physical strength characteristics based on a variation in a sum of the body type index of each of the users constituting the first group and the body type index of each of the users constituting the second group between a first time point and a second time point, and the body type index may be calculated by summing at least some of a converted weight, converted muscle mass, a converted body fat percentage, and converted body balance information.

The comparator may compare the exercise performance between the first group and the second group with different physical strength characteristics based on a variation in the exercise ability index of each of the users constituting the first group and the exercise ability index of each of the users constituting the second group between a first time point and a second time point, the exercise ability index may include a physical strength certification standard grade by age, the comparator may compare a sum of variations in the physical strength certification standard grade by age of each of the users belonging to the first group with a sum of variations in the physical strength certification standard grade by age of each of the users belonging to the second group, and items of the physical strength certification standard may include muscle strength and cardiorespiratory endurance.

The comparator may compare the exercise performance between the first group and the second group with different physical strength characteristics based on a variation in the exercise ability index of each of the users constituting the first group and the exercise ability index of each of the users constituting the second group between a first time point and a second time point, and the exercise ability index may include a $PMW_{AI}$, and the $PMW_{AI}$ is a personal maximum muscle strength value reflecting an individual objectification index calculated based on the workout data of the users collected by the collector.

The comparator may compare the exercise performance between the first group and the second group based on a sum of variations in a $PMW_{AI}$ percentile grade of each of the users constituting the first group and the users constituting the second group with respect to specific fitness equipment.

The workout record index may be calculated as an achievement rate of a workout goal from a start date when the first group and the second group start competing to a competition date, the workout goal includes an exercise load, and the exercise load may be set based on a target weight calculated based on a $PMW_{AI}$ for each user, and the $PMW_{AI}$ may be a personal maximum muscle strength value reflecting an individual objectification index calculated based on the workout data of the users collected by the collector.

The users constituting the first group and the users constituting the second group may use smart gyms in physically different locations.

The exercise performance comparison device may further include a display configured to display a variation in the fitness index of the users constituting the first group or the fitness index of the users constituting the second group on a character representing each of the users constituting the first group or each of the users constituting the second group during a preset period.

Advantageous Effects

According to an embodiment of the present disclosure, the exercise performance comparison device may compare the exercise performance between users with different physical strength characteristics and physical conditions.

BEST MODE

According to an embodiment of the present disclosure, there is provided a method, performed by an exercise performance comparison device, of comparing exercise performance including collecting, by a collector, workout data by communicating with each piece of fitness equipment used by users constituting a first group and users constituting a second group, calculating, by a calculator, a fitness index of the users constituting the first group and a fitness index of the users constituting the second group based on the collected workout data, and comparing, by a comparator, exercise performance between the first group and the second group with different physical strength characteristics based on the fitness index of the users constituting the first group and the fitness index of the users constituting the second group, wherein the fitness index includes at least one of an exercise ability index and a workout record index.

MODE FOR INVENTION

Hereinafter, some embodiments of the present disclosure will be described in detail with reference to the attached drawings in order to enable one of ordinary skill in the art to easily practice the present disclosure.

Figure 1:
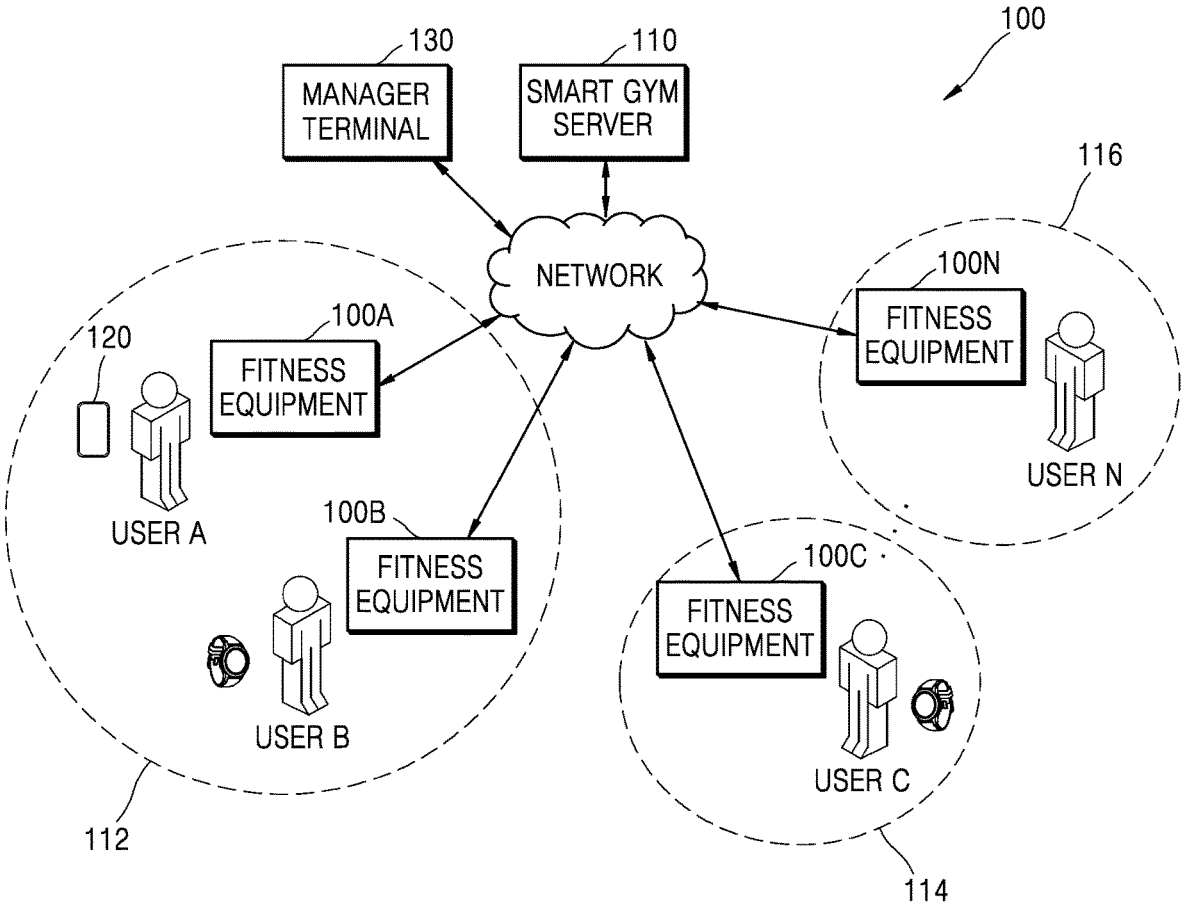
FIG. 1 illustrates a smart gym system, according to an embodiment of the present disclosure.

FIG. 1 illustrates a smart gym system, according to an embodiment of the present disclosure.

A smart gym system 100 includes a smart gym server 110, at least one of pieces of fitness equipment 100*a* through 100*n*, at least one user terminal 120, and a manager terminal 130.

In FIG. 1, the smart gym server 110 may communicate with a first smart gym 112, a second smart gym 114, and an nth smart gym 116, which are physically at different locations, and may transmit or receive data to or from at least one of the pieces of fitness equipment 100*a* and 100*b* provided in the first smart gym 112, at least one piece of the fitness equipment 100*c* provided in the second smart gym 114, and at least one piece of the fitness equipment 100*n* provided in the nth smart gym 116.

According to an embodiment of the present disclosure, a smart gym denotes a physical space that enables a user to provide an athletic performance using fitness equipment to the smart gym server 110, and the smart gym server 110 to learn and analyze the athletic performance of the user and provide workout prescription suitable to the user. The smart gym may be realized as a fitness center, a gym, or a space including fitness equipment.

Users USER A through USER N who come to the smart gym to workout may enter the smart gym after identification when entering the smart gym. For example, the user may enter the smart gym through member verification by tagging the user terminal 120 to an unmanned terminal, such as a kiosk, at an entrance of the smart gym via near field communication (NFC) or radio frequency identification (RFID), or enter the smart gym after member verification at the unmanned terminal through bio-information identification, such as face recognition.

Information about the user who has been verified as a member may be transmitted from the smart gym server 110 to at least one of the pieces of fitness equipment 100*a* through 100*n* through a network. For example, the smart gym server 110 may transmit the information about the user to fitness equipment to which the user tagged the user terminal 120. According to an embodiment of the present disclosure, the information about the user is also referred to as user data, and may include at least some or all of a gender, age, weight, height, body mass index (BMI), and body fat percentage.

The smart gym server 110 may guide the users USER A and USER B who use the fitness equipment 100*a* and 100*b* provided in the first smart gym 112, respectively, with a workout method, a workout intensity, and a workout sequence appropriate to each user. Also, the smart gym server 110 may provide values, such as a target weight and a recommended usage velocity, of the fitness equipment 100*a* and 100*b*. Also, the smart gym server 110 may receive athletic performances of the users USER A and USER B using the fitness equipment 100*a* and 100*b*, respectively. The smart gym server 110 may further receive, from the user terminal 120, log information or health information, such as a user's heart rate, blood pressure, and pulse.

The smart gym server 110 may be realized in a form of a cloud server. The smart gym server 110 may combine pieces of information collected from pieces of fitness equipment in smart gym fitness centers at different locations, and manage the pieces of information. For example, the smart gym server 110 may combine a history of a first user using fitness equipment in the first smart gym 112 at a first location and a history of the first user using fitness equipment in the second smart gym 114 at a second location, and manage the histories.

According to an embodiment of the present disclosure, the at least one of the pieces of fitness equipment 100*a* through 100*n* may be stretching fitness equipment, weight fitness equipment, or aerobic fitness equipment. The weight fitness equipment includes free-weight equipment and machine equipment. The at least one of the pieces of fitness equipment 100*a* through 100*n* may provide an appropriate workout guide to a user through a display attached thereto or a display capable of communicating therewith via wires or wirelessly. For example, the stretching fitness equipment provides a workout guide related to stretching to be performed by a user, through a smart mirror capable of communicating with the stretching fitness equipment. However, an embodiment is not limited thereto, and a workout guide may be provided by using any one of various output methods, such as a speaker or vibration.

At least one of the pieces of fitness equipment 100*a* through 100*n* may perform wired/wireless communication with the smart gym server 110, the user terminal 120, and the manager terminal 130.

According to an embodiment of the present disclosure, the user terminal 120 may be realized in a form of a smart phone, a smart watch, a handheld device, or a wearable device. Also, an application for using the smart gym system may be installed in the user terminal 120. The user terminal 120 may receive workout sequence information from the smart gym server 110. A workout sequence denotes a workout plan planned considering strength and exercise ability of a user. The workout sequence includes information about a fitness equipment list to be used by the user, a target weight of each piece of fitness equipment, and the number of times each piece of fitness equipment is used.

When using at least one of the pieces of fitness equipment 100*a* through 100*n* in the smart gym system 100, a user may perform communication by tagging the user terminal 120 through NFC or RFID, or perform identification by using a physical characteristic of the user. When the identification of the user is completed, the smart gym server 110 may transmit user data to fitness equipment tagged by the user.

Figure 3:
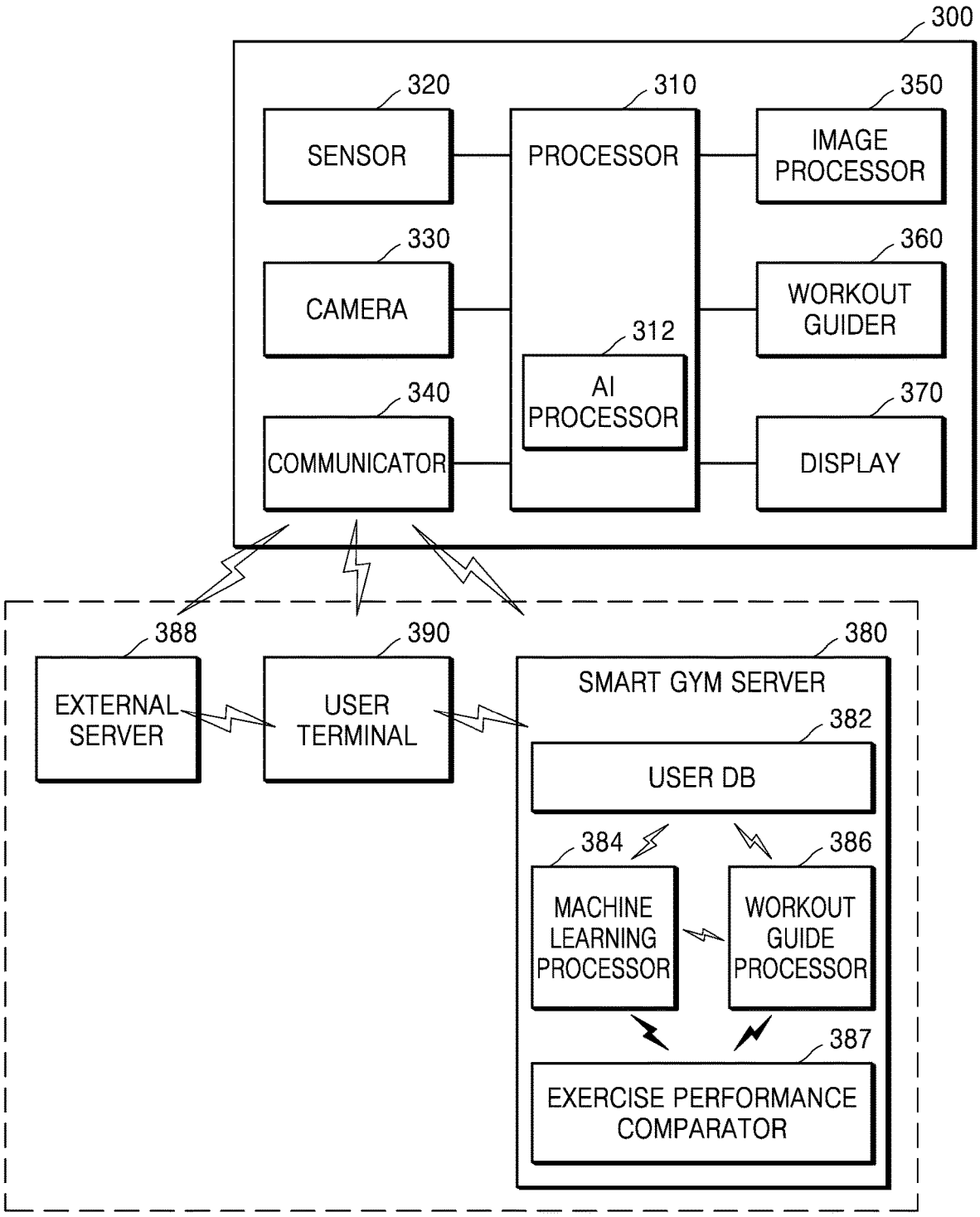
FIG. 3 is a block diagram of an internal configuration of a smart gym server and fitness equipment implementing an AI workout guide method in a smart gym system, according to an embodiment of the present disclosure.

FIG. 3 is a block diagram of an internal configuration of a smart gym server and fitness equipment implementing an artificial intelligence (AI) workout guide method in a smart gym system, according to an embodiment of the present disclosure.

According to an embodiment of the present disclosure, a fitness equipment 300 within the smart gym system may communicate with a smart gym server 380, a user terminal 390, and an external server 388.

According to an embodiment of the present disclosure, the fitness equipment 300 may implement the AI workout guide method and include a processor 310, a sensor 320, a communicator 340, a workout guider 360, and a display 370. Also, the fitness equipment 300 may further include a camera 330 and an image processor 350. The processor 310 may include an AI processor 312 when necessary. The AI workout guide method refers to providing guide information about recommended fitness equipment to be used, a target weight of fitness equipment, the number of times of usage of fitness equipment, a usage velocity of fitness equipment, etc., in accordance with user's physical conditions such as age, gender, weight, etc. and physical strength.

Figure 2:
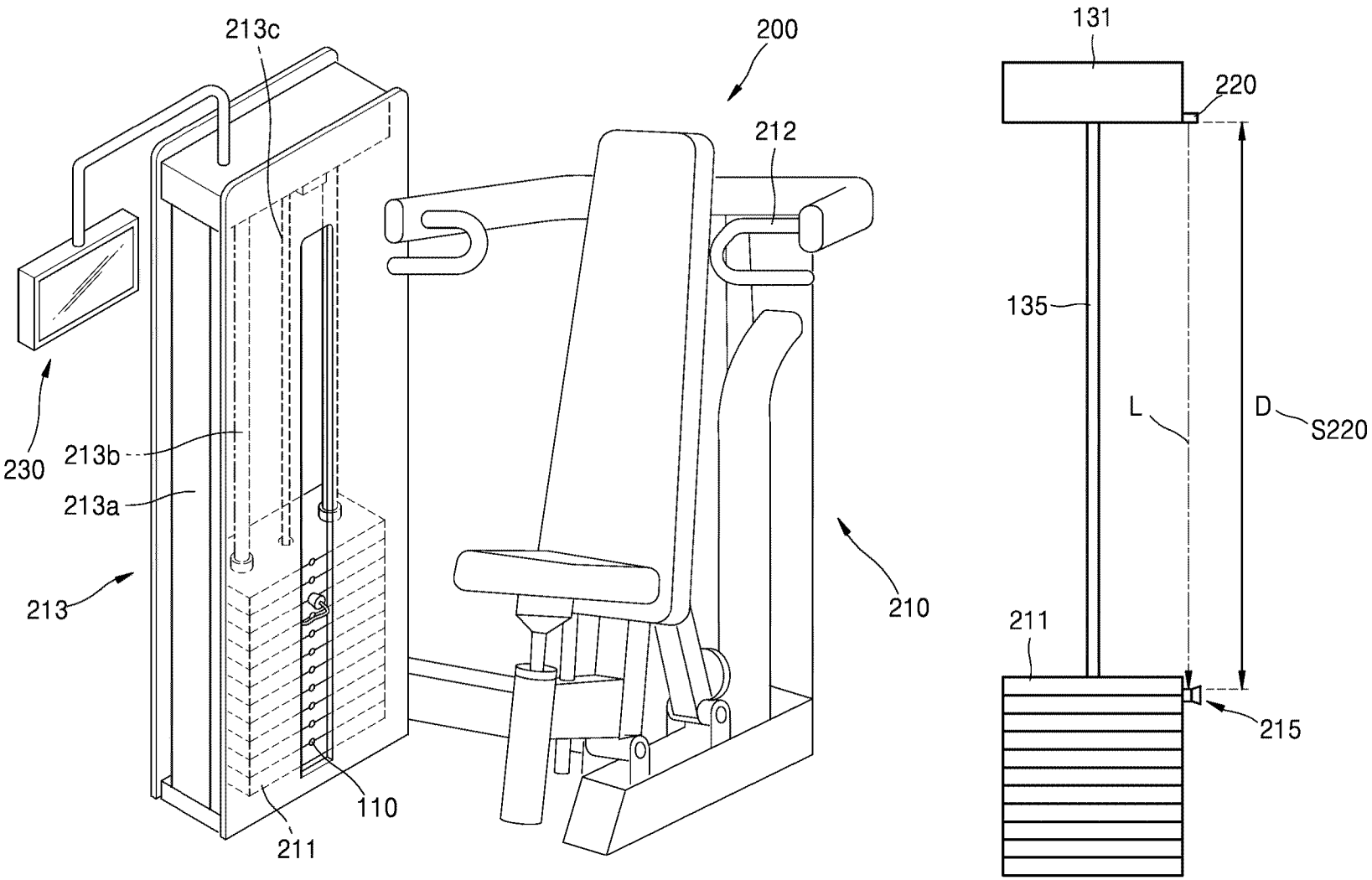
FIG. 2 illustrates an example of fitness equipment provided in a smart gym and implementing an artificial intelligence (AI) workout guide method, according to an embodiment of the present disclosure.

Referring further to FIG. 2, a shoulder press machine 200 is an example of the fitness equipment 300 to which the AI workout guide method used in the smart gym is applied. The fitness equipment 300 will be described with reference to FIGS. 2 and 3.

A sensor 220 may be installed at a frame structure 213 of a fitness body 210. The frame structure 213 includes a base frame 213*a*, a guide rail 213*b*, and a connection line 213*c*. The sensor 220 irradiates a laser beam towards a pin structure 215, receives a reflected laser beam, and measures a distance D S220 from the sensor 220 to the pin structure 215 in real time or in units of pre-set t times. Accordingly, the sensor 220 may detect, in real time, at least one of a location, a moving velocity, and a moving direction of a weight member 211 selected by the pin structure 215. Also, when a user moves a weight plate by pushing a handle 212 of the shoulder press machine 200, the sensor 220 may measure the distance D S220 to the pin structure 215 embedded in the weight plate and detect an exercise trajectory based on the distance D S220.

The communicator 340 may receive a user input through a display 230 or may transmit or receive user data to or from a user DB 382 of the smart gym server 380. The communicator 340 may also communicate with the external server 388.

The workout guider 360 may suggest usage standards to a user when using the fitness equipment. The usage standards include a moving velocity guide indicating the moving velocity moving fitness equipment, a breathing guide indicating a breathing method when moving the fitness equipment, a workout sequence indicating the sequence of usage of fitness equipment selected according to the user's physical strength, a target weight according to a workout purpose of the user, etc.

The workout guider 360 may provide, to the user, information received from the smart gym server 380, such as the user data, the target weight of the fitness equipment, the moving velocity guide of the fitness equipment, the breathing guide when using the fitness equipment, the workout sequence, the target weight according to the workout purpose of the user, etc.

The camera 330 may be embedded in the fitness equipment 300 or may communicate with the fitness equipment 300 wirelessly or via wires, and may capture an image of a workout pose of the user. The image processor 350 may analyze the image of the workout pose of the user, which is captured by the camera 330, through the processor 310. Also, the image processor 350 may learn a result of processing the image of the workout pose, which is captured when the user works out according to a target weight of the fitness equipment, through the AI processor 312, and transmit a result of the learning to the smart gym server 380. The AI processor 312 may also process or learn an individual objectification index of the user.

The smart gym server 380 includes the user DB 382, the machine learning processor 384, and the workout guide processor 386. The user DB 382 stores and manages user data. The user data includes a gender, age, weight, height, BMI, and body fat percentage.

The machine learning processor 384 previously stores personal maximum weight (PMW) percentile grades of the fitness equipment obtained from the population for each fitness equipment as shown in Tables 1 to 3. According to an embodiment of the present disclosure, a PMW denotes muscle strength that may be exerted by an individual against a resistance of a weight with an utmost effort. Examples of the PMW include 1 RM and 4 RM.

Tables 1 to 3 respectively show the PMW percentile grades for chest press machine, leg extension machine, and shoulder press machine. The machine learning processor 384 may generate an updated population PMW by updating the PMW percentile grades obtained from the initial population to a preset unit.

TABLE 1

| PMW percentile grade | Initial population PMW (kg) | Updated population PMW (kg) |
|---|---|---|
| PMW90 | 102.7 | 107.8 |
| . . . | | |
| PMW50 | 67.2 | 67.8 |
| PMW40 | 65.1 | 64.7 |
| . . . | | |
| PMW10 | 24.6 | 23.9 |

TABLE 2

| PMW percentile grade | Initial population PMW (kg) | Updated population PMW (kg) |
|---|---|---|
| PMW90 | 103.3 | 107.8 |
| . . . | . . . | . . . |
| PMW50 | 67.3 | 69.2 |
| PMW40 | 66.5 | 66.8 |
| . . . | . . . | . . . |
| PMW10 | 24.6 | 24.9 |

TABLE 3

| PMW percentile grade | Initial population PMW (kg) | Updated population PMW (kg) |
|---|---|---|
| PMW90 | 64.5 | 65.5 |
| . . . | . . . | . . . |
| PMW50 | 43.3 | 43.2 |
| PMW40 | 41.2 | 40.2 |
| . . . | . . . | . . . |
| PMW10 | 16.1 | 16.3 |

The machine learning processor 384 also learns and processes the individual objectification index including athletic performances of the user on pieces of fitness equipment used in the smart gym. Examples of the individual objectification index include an athletic performance, a weight of fitness equipment determined when the fitness equipment is used, the number of repetitions (reps), the number of sets, an exercise trajectory, a moving velocity, and regularity of reps in units of sets. The individual objectification index may also be learned and processed by selecting and summing multiple data or indicators according to certain criteria from data such as the weight of fitness equipment, the reps, the number of sets, the exercise trajectory, the moving velocity, and the regularity of reps in units of sets.

In an embodiment of the present disclosure, the 'data' refers to raw data measured by a device or directly input. The 'indicators' refer to information obtained by processing or measuring the data. Also, the 'index' refers to a comprehensive score obtained by selecting and summing multiple data or indicators according to certain criteria.

According to another embodiment of the present disclosure, the machine learning processor 384 may, when reps is used as the individual objectification index, determine completion of the reps based on regularity between exercise trajectories of all reps configuring one set, convert a degree of the completion of the reps into a numerical value, and use the numerical value as the individual objectification index.

For example, the machine learning processor 384 determines, according to a pre-set standard, that an ascent starting point 611 is appropriate when the ascent starting point 611 is 0 to ta seconds, and is late when the ascent starting point 611 exceeds ta seconds. Also, the completion may be rated good, fair, or bad or scored from 1 to 10, according to a pre-set standard for the appropriate ascent starting point 611. Similarly, according to a pre-set standard, when an ascending section velocity V1 S610 is between Va and Vb, it is determined that the ascending section velocity V1 S610 is appropriate, when the ascending section velocity V1 S610 exceeds Vb, it is determined that the ascending section velocity V1 S610 is fast, and when the ascending section velocity V1 S610 is less than Va, it is determined that the ascending section velocity V1 S610 is slow. A result of determining appropriate, fast, or slow may be rated good, fair, or bad or scored from 1 to 10.

Similarly, the machine learning processor 384 determines the completion of the exercise trajectory detected when the user uses the fitness equipment, by using at least some of the ascent starting point 611, a descent starting point 613, the ascending section velocity V1 S610, a descending section velocity V2 S620, the ascending section average velocity, the descending section average velocity, and a height H 612. Also, the individual objectification index may be calculated by converting a degree of the completion of the exercise trajectory.

Figure 4:
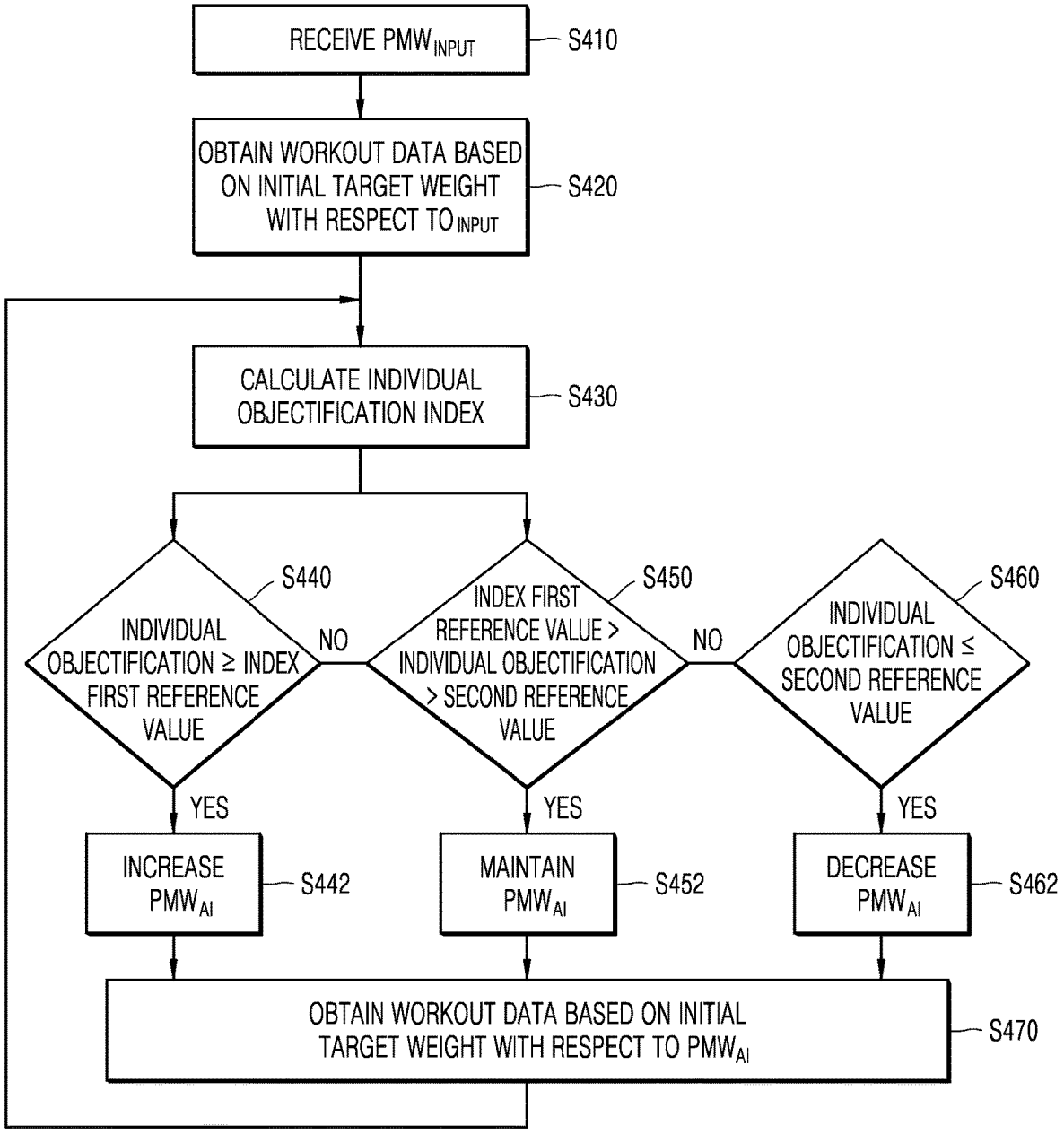
FIG. 4 is a flowchart of a method of correcting a personal maximum weight (PMW) input into a $PMW_{AI}$, according to an embodiment of the present disclosure.

Referring further to FIG. 4, the workout guide processor 386 may automatically correct a $PMW_{input}$ (S410) received from the user into a $PMW_{AI}$ based on the individual objectification index (S420 and S430) calculated from workout data acquired during a preset period (S442, S452, and S462).

The workout guide processor 386 calculates the workout data of the user acquired during the preset period as the individual objectification index through deep learning or machine learning (S420 and S430), automatically reflects the calculated individual objectification index, and correct the $PMW_{input}$ input by the user into the $PMW_{AI}$ (S442, S452, and S462). For example, the workout guide processor 386 corrects the $PMW_{AI}$ to a value greater than the $PMW_{input}$ when the individual objectification index is a first reference value or more (S442), and corrects the $PMW_{AI}$ to a value less than the $PMW_{input}$ when the individual objectification index is a second reference value or less (S462). And, when the individual objectification index is less than the first reference value and more than the second reference value, the workout guide processor 386 corrects the $PMW_{AI}$ to the same value as the $PMW_{input}$ (S452).

According to an embodiment of the present disclosure, the workout guide processor 386 may use the PMW percentile grades as shown in Tables 1 to 3 as an increment or a decrement when correcting the $PMW_{input}$ to the $PMW_{AI}$. For example, when the individual objectification index is the first reference value or more, the workout guide processor 386 may increase the $PMW_{AI}$ percentile grade by one level. When the individual objectification index is the second reference value or less, the workout guide processor 386 may decrease the $PMW_{AI}$ percentile grade by one level. In Tables 1 to 3, the percentile grades are indicated in 10 units, but it should be noted that percentile values may be designed in various ways, such as 1 unit, 5 units, and 10 units.

For example, when an individual objectification index calculated based on an exercise trajectory with respect to an initial target weight value of the user who uses a chest press machine with the $PMW_{input}$ 65 kg belongs to 8 and 10 out of 10, the workout guide processor 386 updates the $PMW_{AI}$ to a value greater than the $PMW_{input}$. As an example, the workout guide processor 386 updates the $PMW_{AI}$ to a percentile level one level higher than a percentile value to which the $PMW_{input}$ belongs. When the percentile value to which the $PMW_{input}$ 65 kg belongs is PMW40, the workout guide processor 386 updates the $PMW_{AI}$ to 67.2 kg corresponding to PMW50. When the individual objectification index calculated based on the exercise trajectory with respect to the initial target weight value of the user who uses the chest press machine with the $PMW_{input}$ 65 kg is a range of 5 and 7, the workout guide processor 386 confirms the $PMW_{AI}$ as the $PMW_{input}$. Also, when the individual objectification index calculated based on the exercise trajectory with respect to the initial target weight value of the user who uses the chest press machine with the $PMW_{input}$ 65 kg is a range of 1 to 4, the workout guide processor 386 updates the $PMW_{AI}$ to a percentile level one level lower than the percentile value to which the $PMW_{input}$ belongs. When the percentile value to which the $PMW_{input}$ 65 kg belongs is the PMW40, the workout guide processor 386 updates the $PMW_{AI}$ to a weight corresponding to PMW30.

Even after correcting the $PMW_{input}$ to the $PMW_{AI}$, the workout guide processor 386 may calculate the individual objectification index based on the workout data acquired in units of the preset period and newly update the $PMW_{AI}$ (S470).

An exercise performance comparator 387 compares exercise performance between users with different physical strength characteristics. To this end, the exercise performance comparator 387 calculates a fitness index of each user to compare different physical strength characteristics. The fitness index represents a score or numerical value generated based on workout data to provide a fitness service in accordance with user individual characteristics. The function of the exercise performance comparator 387 is described in detail with reference to FIG. 5.

Figure 5:
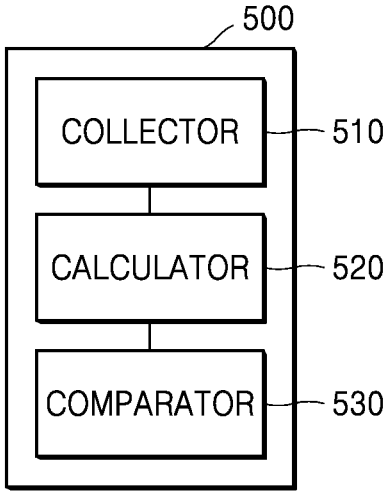
FIG. 5 is a block diagram of an internal configuration of an exercise performance comparison device, according to an embodiment of the present disclosure.
Figure 6:
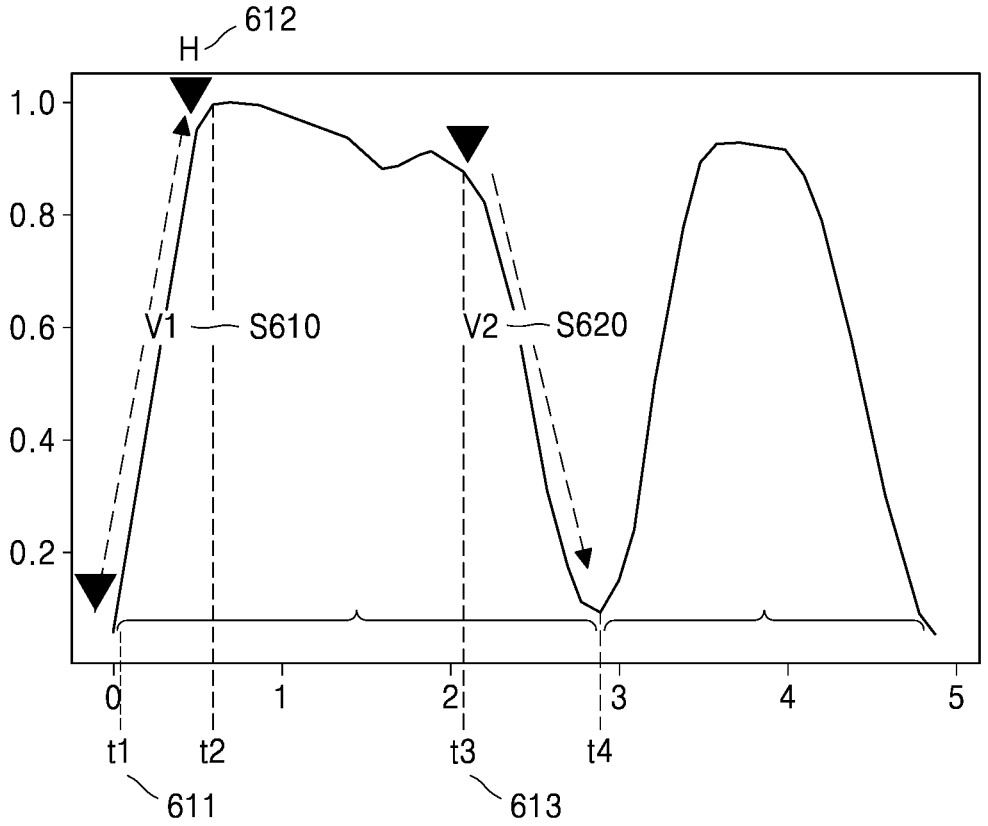
FIG. 6 illustrates an example of an exercise trajectory detected by fitness equipment, according to an embodiment of the present disclosure.

FIG. 5 is a block diagram of an internal configuration of an exercise performance comparison device 500, according to an embodiment of the present disclosure.

The exercise performance comparison device 500 includes a collector 510, a calculator 520, and a comparator 530, and may further include a display 540.

The collector 510 collects workout data of users by communicating with fitness equipment used by the users. The collector 510 may collect workout data of fitness equipment to which the users have tagged the user terminal 120. The collector 510 collects workout data of fitness equipment used by each of n users constituting a first group, and also collects workout data of fitness equipment used by each of m users constituting a second group. In this case, n and m are natural numbers and may be the same or different. The n users constituting the first group or the m users constituting the second group may all use fitness equipment in the same physically smart gym or use fitness equipment in physically different smart gyms. The collector 510 may collect workout data of fitness equipment tagged by a first user with the user terminal 120 in a first smart gym and workout data of fitness equipment tagged by the first user with the user terminal 120 in a second smart gym.

The calculator 520 calculates fitness indexes of each user based on the collected workout data. The fitness indexes include a body type index, an exercise ability index, a workout record index, etc.

The body type index is used to evaluate the current body condition in comparison to a user's body type goal. The higher the body type index, the more the user is reaching the user's body type goal.

The body type index may be calculated by converting at least some of weight, muscle mass, body fat percentage, and body balance information into converted weight, converted muscle mass, converted fat percentage, and converted body balance information according to preset standards, and summing at least some of the converted weight, the converted muscle mass, the converted fat percentage, and the converted body balance information. The body type index may use in-body data.

The converted weight is converted based on the weight between a user's target weight and a user's current weight. It is classified as serious when the user's converted weight is less than 80%, below standard when 80% to 90%, standard when 90% to 110%, above standard when 110% to 120%, obese when 120% to 130%, and severe obesity when 130%. Also, scores are given to the converted weight. For example, when converted to a 5-point scale, scores may be converted into 5 points for standard, 4 points for below standard, 3 points for above standard, 2 points for serious and obese, and 1 point for severe obesity.

With regard to the converted muscle mass, it is classified as a weak type when the muscle mass shown in the in-body data of the user is less than 80%, below standard when 80% to 90%, standard when 90% to 110%, above standard when 110% to 120%, and a muscle type when exceeding 120%. Also, scores are given to the converted muscle mass. For example, when converted to a 5-point scale, scores may be converted into 5 points for the muscle type, 4 points for above standard, 3 points for standard, 2 points for below standard, and 1 point for the weak type.

With regard to the converted body fat percentage, for men, it is classified as an athlete type when the body fat percentage shown in the in-body data of the user is less than 10%, below standard when 10% to 15%, standard when 15% to 20%, above standard when 20% to 25%, obesity when 25% to 30%, and severe obesity when exceeding 30%. For women, it is classified as the athlete type when the body fat percentage shown in the in-body data of the user is less than 18%, below standard when 18% to 23%, standard when 23% to 28%, above standard when 28% to 33%, obesity when 33% to 38%, and severe obesity when exceeding 38%. Also, scores are given to the converted body fat percentage.

The converted body balance information represents average values of upper and lower balance scores and left and right balance scores of the user. An upper and lower balance classifies the condition of the upper body or lower body as developed, standard, or weak. Also, scores are given to the converted upper and lower balance. A left and right balance also classifies the condition of the upper body or lower body as balance and imbalance. Also, scores are given to the converted left and right balance.

The comparator 530 may compare the exercise performance between the first group and the second group with different physical strength characteristics by comparing the body type indexes of the n users constituting the first group and the body type indexes of the m users constituting the second group between a first time point and a second time point. In an embodiment of the present disclosure, the body type index may compare exercise performance between a plurality of users or groups with different physical strength characteristics by using the converted body weight, the converted muscle mass, the converted body fat percentage, or the converted body balance information.

According to an embodiment of the present disclosure, the exercise ability index includes physical strength certification standard grades by age or the $PMW_{AI}$.

The physical strength certification standard grade by age refers to preset standards for certifying physical strength by childhood, adolescence, adulthood, seniors, or age groups. The physical strength certification standard grade by age may be different for men or women. Examples of physical strength certification standard include cardiorespiratory endurance, muscle strength, muscle endurance, flexibility, agility, and quickness. The physical strength certification standard grades by age may be classified into percentiles or preset number of grades.

For example, the physical strength certification standard grade by age for cardiorespiratory endurance follow preset standards such as 15 m round trip long run for childhood, 20 m roundtrip long run for adolescence, treadmill for adulthood, and 2 minutes walking in place for seniors.

The comparator 530 may compare the exercise performance between the first group and the second group by comparing the sum of variations in the physical strength certification standard grade by age of each of the n users belonging to the first group and the sum of variations in the physical strength certification standard grade by age of each of the m users belonging to the second group between the first time point and the second time point. In an embodiment of the present disclosure, it is possible to compare the exercise performance between groups of people of different ages by setting different the physical strength certification standard grade by age and setting different physical strength certification standard grades by age.

According to another embodiment of the present disclosure, the exercise ability index includes the $PMW_{AI}$. The $PMW_{AI}$ represents a personal maximum muscle strength value reflecting the individual objectification index calculated based on the workout data of the users collected by the collector 510.

The comparator 530 may identify a variation of the muscle strength of the first user based on a difference between the $PMW_{AI}$ of the first user at the first time point and the $PMW_{AI}$ of the first user at the second time point using the same fitness equipment.

The comparator 530 may compare the exercise performance between the first group and the second group by summing the variations in the $PMW_{AI}$ of each of the n users constituting the first group and the m users constituting the second group between the first time point and the second time point with respect to at least one specific fitness equipment. In this case, the display 540 may display the $PMW_{AI}$ of the n users constituting the first group and the m users constituting the second group at the first time point and the second time point on a character representing each user. The display 540 may also display a variation in the fitness index other than the $PMW_{AI}$ on each character.

In addition, the comparator 530 may compare the exercise performance between the first group and the second group based on the sum of the variations in the $PMW_{AI}$ percentile grade of the n users constituting the first group and the m users constituting the second group. In an embodiment of the present disclosure, the comparator 530 may compare the exercise performance between the first group and the second group based on the variations in the $PMW_{AI}$ percentile grade, and thus, comparison between users with different physical strength characteristics is possible. In other words, comparison is possible by reflecting different physical strength characteristics of users, such as a beginner who has started workout may have a great variation in a workout load, but a user who has worked out for a long time may not have a great variation in the workout load.

According to another embodiment of the present disclosure, the fitness indexes include the workout record index.

The workout record index may be calculated as an achievement rate of a workout goal of each of the n users constituting the first group and the m users constituting the second group from the first time point to the second time point. For example, the workout goal of each of the n users constituting the first group and a workout goal of each of the m users constituting the second group may increase by 10 units from the PMW percentile at the first time point. For example, the workout goal increases by 10 units from the PMW30 to the PMW40.

Alternatively, the workout goal may be set according to a workout purpose of each user. As for the workout goal, the workout load is set differently when using the fitness equipment according to the workout purpose set by the user. Workout purposes include a free workout, a standard workout, a muscle building workout, a conditioning workout, etc., and the load of fitness equipment may be set differently according to each workout purpose. In the free workout, the workout load of the fitness equipment may be set to $PMW_{AI}*P_{Free}$ (%). $P_{Free}$ may be a user input value. In the standard workout, the workout load of the fitness equipment may be set to $PMW_{AI}*P_{standard}$ (%). For example, $P_{standard}$ (%)=60, reps may be set to 6, and the number of sets may be set to 3. In the muscle building workout, the workout load of the fitness equipment may be set to $PMW_{AI}*P_{muscle\ building}$ (%). For example, the $P_{muscle\ building}$ (%) may be set to 65% to 85%, and reps may be set to 6 times to 12 times. Also, in the conditioning workout, the workout load of the fitness equipment may be set to $PMW_{AI}*P_{conditioning}$ (%).

As described above, the workout goal of each of the n users constituting the first group and the workout goal of each of the m users constituting the second group from the first time point to the second time point are set. In this case, the workout goal of each of the n users constituting the first group and the workout goal of each of the m users constituting the second group may be different.

The comparator 530 may determine an index of the workout goal achievement rate of each of the n users constituting the first group and each of the m users constituting the second group at the second time point and compare the exercise performance between the first group and the second group.

Figure 7:
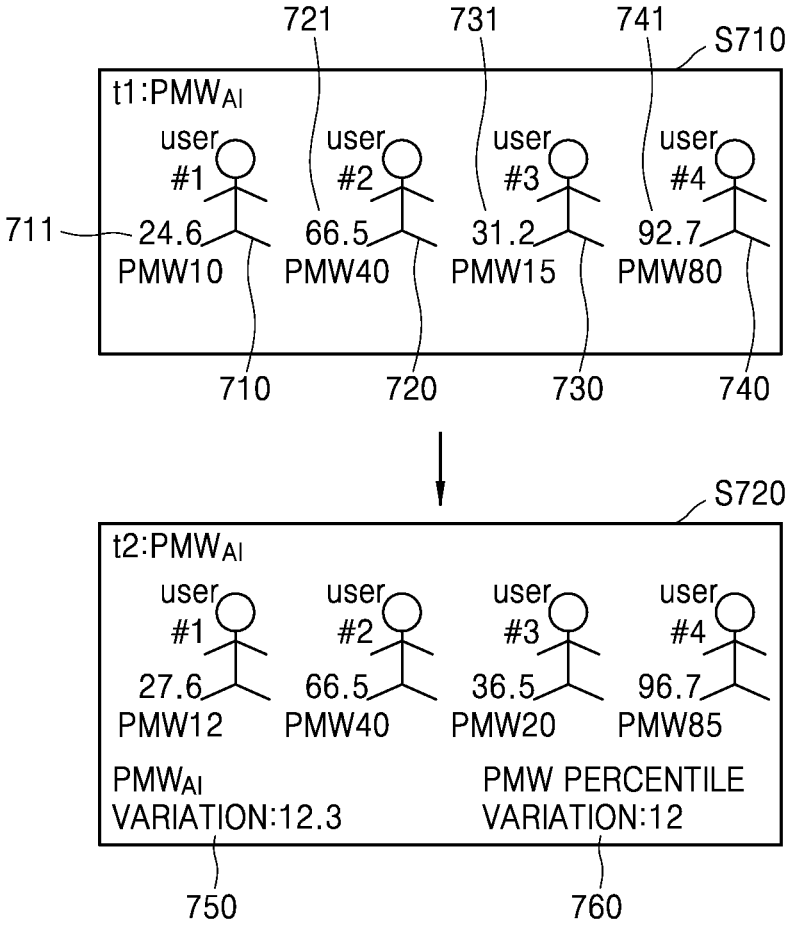
FIG. 7 illustrates an example of a display displaying a variation in a fitness index, according to an embodiment of the present disclosure.

FIG. 7 illustrates an example of a display displaying a variation in a fitness index, according to an embodiment of the present disclosure.

When a first group includes four users 710, 720, 730, and 740, the display may display four characters respectively representing the four users 710, 720, 730, and 740. Also, the display may display the fitness index on each of the four characters.

Referring to FIG. 7, the display may display the $PMW_{AI}$ among fitness indexes on each of the four characters. In an embodiment of the present disclosure, the $PMW_{AI}$ may be set for each piece of fitness equipment used by a user. The display may display the $PMW_{AI}$ at a location of a main muscle that is most activated when using fitness equipment. For example, when the four users 710, 720, 730, and 740 in the first group use a leg extension machine, the display may record the $PMW_{AI}$ in the quadriceps muscle area that is most activated when using the leg extension machine (711, 721, 731, and 741).

The display may display the $PMW_{AI}$ S710 at a first time point t1 and the $PMW_{AI}$ S710 at a second time point t2. Also, the display may display a variation 750 in the $PMW_{AI}$ between the first time point t1 and the second time point t2.

Figure 8:
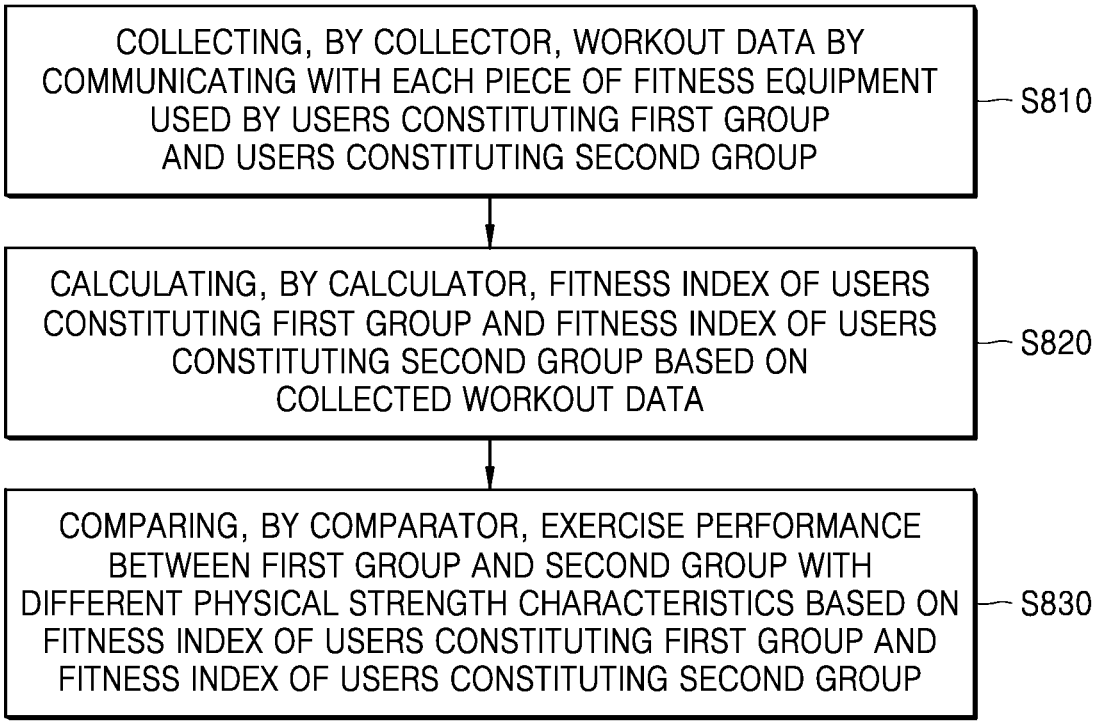
FIG. 8 is a flowchart of comparing exercise performance in a smart gym server, according to an embodiment of the present disclosure.

FIG. 8 is a flowchart of comparing exercise performance in a smart gym server, according to an embodiment of the present disclosure.

A collector collects workout data by communicating with each piece of fitness equipment used by users constituting a first group and users constituting a second group (S810). A calculator calculates a fitness index of the users constituting the first group and the users constituting the second group based on the workout data collected by the collector (S820). A comparator compares exercise performance between the first group and the second group with different physical strength characteristics based on the fitness index of the users constituting the first group and the fitness index of the users constituting the second group (S830).

Methods according to embodiments may be recorded on a computer-readable recording medium by being implemented in a form of program commands executed by using various computers. The computer-readable recording medium may include at least one of a program command, a data file, or a data structure. The program commands recorded in the computer-readable recording medium may be specially designed or well known to one of ordinary skill in the computer software field.

While one or more embodiments have been described with reference to the figures, it will be understood by those of ordinary skill in the art that various changes in form and details may be made therein without departing from the spirit and scope of the disclosure as defined by the following claims.

The invention claimed is:

1. A smart gym system configured to compare exercise performance, the system comprising:

a plurality of fitness equipment configured to transmit workout data over a network;

a smart gym server configured to communicate with the plurality of fitness equipment;

a memory storing instructions; and at least one processor configured to execute the instructions, wherein the instructions, when executed by the at least one processor, cause the at least one processor to:

receive workout data from the plurality of fitness equipment used by users constituting a first group and users constituting a second group, the first group and the second group having different physical strength characteristics, wherein the workout data is generated from operation of corresponding fitness equipment of the plurality of fitness equipment during repetitions performed by each of the users and includes at least one machine-generated parameter selected from a weight of fitness equipment, a number of repetitions, a number of sets, an exercise trajectory, a moving velocity, and a regularity of repetitions in units of sets;

calculate, for each of the users, an individual objectification index based on the collected workout data, wherein the individual objectification index is calculated by quantifying a degree of completeness of the repetitions based on the regularity of exercise trajectories of the repetitions composing one set;

determine, for each of the users, a personal maximum muscle strength value index ($PMW_{AI}$) reflecting the individual objectification index;

compare the individual objectification index with a first reference value and a second reference value, and update the $PMW_{AI}$ by:

increasing the $PMW_{AI}$ when the individual objectification index is at least the first reference value, decreasing the $PMW_{AI}$ when the individual objectification index is at most the second reference value, and maintaining the $PMW_{AI}$ when the individual objectification index is less than the first reference value and greater than the second reference value;

calculate, for each of the users, a target weight based on the updated $PMW_{AI}$;

determine, for each of the users, exercise-load information for setting an exercise load of the corresponding fitness equipment based on the target weight;

transmit the target weight and the exercise-load information to a display device of the corresponding fitness equipment or a user terminal to display the target weight and the exercise-load information to the user;

calculate, for each of the users, a workout record index as an achievement rate of a workout goal over a period from a first time point to a second time point, wherein the workout goal includes an exercise load set based on the target weight;

calculate, for each of the users, a fitness index including at least one of an exercise ability index and the workout record index, wherein the exercise ability index includes the $PMW_{AI}$;

compare exercise performance between the first group and the second group based on the fitness index of the users constituting the first group and the fitness index of the users constituting the second group; and control the display device to display a result of the comparison of exercise performance between the first group and the second group.

2. The smart gym system of claim 1, wherein the fitness index further includes a body type index, wherein the instructions, when executed by the at least one processor, further cause the at least one processor to:

compare the exercise performance between the first group and the second group with different physical strength characteristics based on a variation in a sum of the body type index of each of the users constituting the first group and the body type index of each of the users constituting the second group between a first time point and a second time point, and wherein the body type index is calculated by summing at least some of a converted weight, converted muscle mass, a converted body fat percentage, and converted body balance information.

3. The smart gym system of claim 1, wherein the instructions, when executed by the at least one processor, further cause the at least one processor to:

compare the exercise performance between the first group and the second group with different physical strength characteristics, based on a variation in the exercise ability index of each of the users constituting the first group and the exercise ability index of each of the users constituting the second group between a first time point and a second time point, wherein the exercise ability index includes a physical strength certification standard grade by age, compare a sum of variations in the physical strength certification standard grade by age of each of the users belonging to the first group with a sum of variations in the physical strength certification standard grade by age of each of the users belonging to the second group, and wherein items of the physical strength certification standard include muscle strength and cardiorespiratory endurance.

4. The smart gym system of claim 1, wherein the instructions, when executed by the at least one processor, further cause the at least one processor to:

compare the exercise performance between the first group and the second group, the first group and the second group having different physical strength characteristics, based on a variation in the $PMW_{AI}$ of each of the users constituting the first group and the $PMW_{AI}$ of each of the users constituting the second group between a first time point and a second time point.

5. The smart gym system of claim 1, wherein the exercise performance between the first group and the second group is compared based on a sum of variations in a $PMW_{AI}$ percentile grade of each of the users constituting the first group and the users constituting the second group with respect to specific fitness equipment.

6. The smart gym system of claim 1, wherein the workout record index is calculated as an achievement rate of a workout goal from a start date when the first group and the second group start competing to a competition date, the workout goal includes an exercise load, and the exercise load is set based on a target weight calculated based on the updated $PMW_{AI}$ for each user.

7. The smart gym system of claim 1, wherein the users constituting the first group and the users constituting the second group use smart gyms in physically different locations.

8. The smart gym system of claim 1, further comprising:

a display configured to display a variation in the fitness index of the users constituting the first group or the fitness index of the users constituting the second group, on a character representing each of the users constituting the first group or each of the users constituting the second group, during a preset period.

9. A method, performed by a smart gym system, of comparing exercise performance, the method comprising:

receiving workout data from a plurality of fitness equipment used by users constituting a first group and users constituting a second group, the first group and the second group having different physical strength characteristics;

wherein the workout data is generated from operation of corresponding fitness equipment during repetitions performed by each of the users and includes at least one machine-generated parameter selected from a weight of fitness equipment, a number of repetitions, a number of sets, an exercise trajectory, a moving velocity, and a regularity of repetitions in units of sets;

calculating, for each of the users, an individual objectification index based on the workout data, wherein the individual objectification index is calculated by quantifying a degree of completeness of the repetitions based on the regularity of exercise trajectories of the repetitions composing one set;

determining, for each of the users, a personal maximum muscle strength value index ($PMW_{AI}$) reflecting the individual objectification index;

comparing the individual objectification index with a first reference value and a second reference value, increasing the $PMW_{AI}$ when the individual objectification index is at least the first reference value, decreasing the $PMW_{AI}$ when the individual objectification index is at most the second reference value, and maintaining the $PMW_{AI}$ when the individual objectification index is less than the first reference value and greater than the second reference value;

calculating a target weight for each of the users based on the updated $PMW_{AI}$;

determining, for each of the users, exercise-load information for setting an exercise load of the corresponding fitness equipment based on the target weight;

transmitting the target weight and the exercise-load information to a display device of the corresponding fitness equipment or a user terminal to display the target weight and the exercise-load information to the user;

calculating, for each of the users, a workout record index as an achievement rate of a workout goal over a period from a first time point to a second time point, wherein the workout goal includes an exercise load set based on the target weight;

calculating, for each of the users, a fitness index including at least one of an exercise ability index and the workout record index, wherein the exercise ability index includes the $PMW_{AI}$; and comparing exercise performance between the first group and the second group based on the fitness index of the users constituting the first group and the fitness index of the users constituting the second group.

10. The method of claim 9, further comprising: displaying, by a display, a variation in the fitness index of the users constituting the first group or the fitness index of the users constituting the second group, on a character representing each of the users constituting the first group or each of the users constituting the second group, during a preset period.

11. The method of claim 9, wherein the users constituting the first group and the users constituting the second group use smart gyms in physically different locations.

12. The method of claim 9, wherein the fitness index further includes a body type index, the method further comprising: comparing the exercise performance between the first group and the second group with different physical strength characteristics, based on a variation in a sum of the body type index of each of the users constituting the first group and the body type index of each of the users constituting the second group between a first time point and a second time point, wherein the body type index is calculated by summing at least some of a converted weight, converted muscle mass, a converted body fat percentage, and converted body balance information.

13. The method of claim 9, further comprising:

comparing the exercise performance between the first group and the second group with different physical strength characteristics, based on a variation in the exercise ability index of each of the users constituting the first group and the exercise ability index of each of the users constituting the second group between a first time point and a second time point, wherein the exercise ability index includes a physical strength certification standard grade by age, comparing a sum of variations in the physical strength certification standard grade by age of each of the users belonging to the first group with a sum of variations in the physical strength certification standard grade by age of each of the users belonging to the second group, wherein items of the physical strength certification standard include muscle strength and cardiorespiratory endurance.

14. The method of claim 9, further comprising: comparing, the exercise performance between the first group and the second group with different physical strength characteristics, based on a variation in the exercise ability index of each of the users constituting the first group and the exercise ability index of each of the users constituting the second group between a first time point and a second time point.

15. A non-transitory computer-readable recording medium storing instructions that, when executed by a computing device, cause the computing device to perform the method of claim 9.

* * * * *